United States Patent [19]

Rusteberg

[11] 4,422,450

[45] Dec. 27, 1983

[54] ACTINIC OZONE PERIODONTAL IRRIGATING APPARATUS AND METHOD

[75] Inventor: Robert K. Rusteberg, Barrington Hills, Ill.

[73] Assignee: Panlmatic Company, Elk Grove Village, Ill.

[21] Appl. No.: 402,792

[22] Filed: Jul. 28, 1982

[51] Int. Cl.[3] ..... A61H 7/00

[52] U.S. Cl. ..... 128/62 A; 128/66; 128/1 R; 604/25

[58] Field of Search ..... 128/62 A, 66, 1 R; 604/25; 210/760, 765

[56] References Cited

U.S. PATENT DOCUMENTS

| | | | |
|---|---|---|---|
| 1,075,002 | 10/1913 | Bandieri | 604/25 |
| 4,078,558 | 3/1978 | Woog et al. | 128/66 |
| 4,196,726 | 4/1980 | Ronzi | 604/25 |
| 4,230,571 | 10/1980 | Dadd | 210/760 |

*Primary Examiner*—C. Fred Rosenbaum
*Assistant Examiner*—Sherri Vinyard
*Attorney, Agent, or Firm*—Robert E. Wagner; Stephen R. Arnold; Ralph R. Rath

[57] ABSTRACT

A germicidal periodontal irrigation system employs a stream of irrigating liquid in which bubbles of ultraviolet-produced ozone are finely dispersed. The flow of irrigating liquid through an irrigation conduit carries the ozone bubbles to the inflamed areas to effect a germicidal action. Ozonation of the carrier liquid is produced by passing a gas containing oxygen in the immediate vicinity of an irradiating ultraviolet lamp to produce "actinic" ozone, the gas then being bubbled through a storage reservoir from which the irrigating liquid is continuously drained and dispensed, carrying the ozone bubbles along with it. Alternatively, the ozonated gas is injected directly into the irrigation conduit to form a stream of finely-dispersed bubbles in the flowing liquid. The irrigating stream is preferably dispensed in the form of a high-pressure pulsating jet of liquid injected at the gum line to provide a high local concentration of ozone for germicidal treatment.

14 Claims, 2 Drawing Figures

S1
15
26
19
21
24
22
20
28
24
3
1
2
5
8
6
6
9
7
10
30
9'
32
34
36
32
11

36
34
32
11
3'
32
S1
S2
28'
9
P
P2
22
19
P1
45
P
8
6
6
26

ACTINIC OZONE PERIODONTAL IRRIGATING APPARATUS AND METHOD

DESCRIPTION

1. Technical Field

The technical field of the invention is an improvement in the art of germicidal periodontal treatment.

2. Background of the Prior Art

Pulse-pressurized irrigation systems are frequently employed for the treatment of periodontal disease. Such treatments involve typically the use of a high-velocity jet of liquid directed at the gum line, the liquid being supplied from a storage tank and dispensed at high pressure by means of a pump, pressurized pulses of the germicidal liquid emerging from a dispensing nozzle. One such unit is currently marketed in the United States under the trademark "WATER-PIK".

Although frequently water alone is used as the irrigant, germicidal agents such as hydrogen peroxide may alternatively be dispensed for increased germicidal efficiency. Any germicide dispensed by such system in periodontal treatment must be sufficiently powerful to have substantial germicidal power, but at the same time be safe if swallowed in small quantities by the user during the course of treatment. Thus, many of the more powerful germicidal agents cannot be used in such a system.

There is a need for an adequate non-toxic non-irritating germicidal irrigating agent. Such an irrigant should be in liquid form or in a liquid carrier such that it can be directed locally at infected tissues by an irrigating nozzle.

BRIEF SUMMARY OF THE INVENTION

The applicant has found that a species of ozone gas dispersed as fine bubbles in water and dispensed from a periodontal irrigation unit appears to give efficacious results in treating periodontal infections. It is believed that this germicidal action may arise from an anaerobic property of the bacteria involved, however, other mechanisms may be involved as well.

A germicidal dispersion of fine bubbles of ozone produced by the action of actinic ultraviolet on oxygen gas is produced in water. A stream of water carrying the ozone dispersal is directed toward the inflamed tissues to act as a germicidal irrigating agent. The germicidal dispersion is most efficaciously dispensed under pressure at the gum line.

Two embodiments are presented. The first consists of means for producing actinic ozone in the form of finely dispersed bubbles in the fluid reservoir of an irrigating apparatus. A preferred embodiment achieves a higher concentration of bubbles at the site of the inflamed tissues by introducing the bubbles directly into the water line a short distance from the dispenser nozzle.

In either embodiment, a germicidal action results as the dispersed ozone bubbles strike the surface of the inflamed tissues. Since the ozone in such concentrations is apparently non-toxic, the water dispersion containing ozone may be swallowed in modest quantities without harm to the patient.

DETAILED DESCRIPTION OF THE INVENTION

Figure 1:
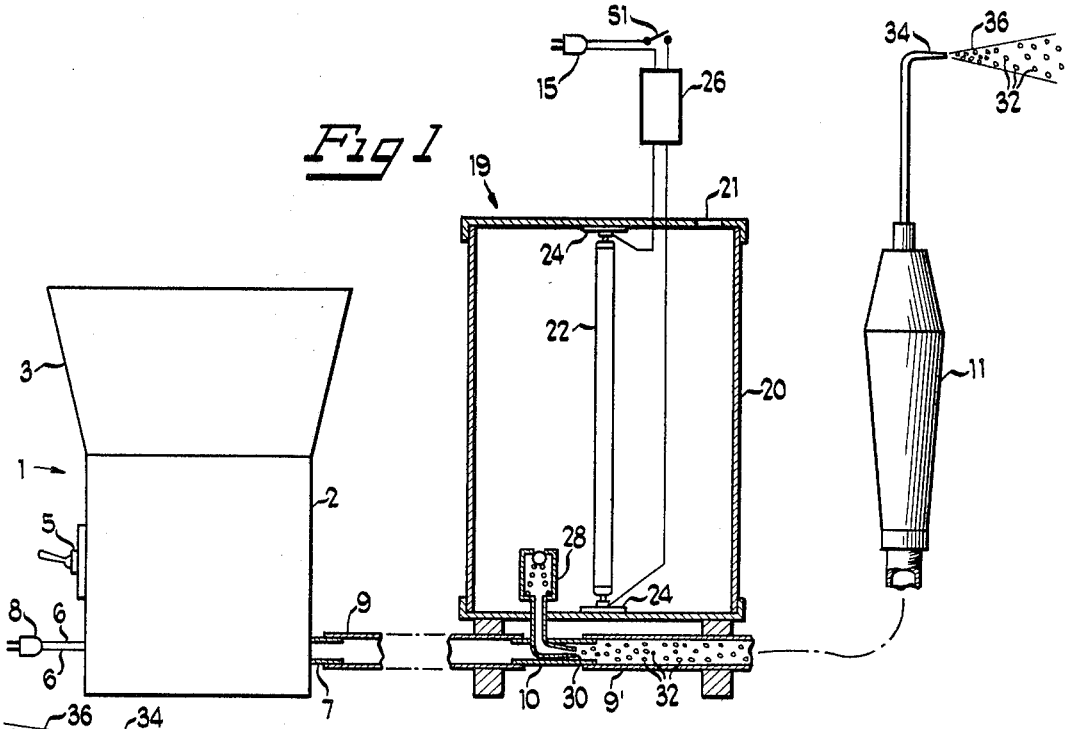
FIG. 1 is a side view partly in section of the preferred embodiment of the invention.

FIG. 1 shows the preferred embodiment of the invention. A conventional irrigating pump and reservoir system 1 consists of a water reservoir 3 on top of a pump base 2 containing a pulsing pump (not shown). The pump is electrically powered from a wall plug 8 delivering electrical power along lines 6 and controlled by a slide switch 5 to actuate the pump to dispense a high-pressure pulsating stream of the liquid contained in reservoir 3 to a tubulation outlet coupling 7. A tubulation 9 conducts the irrigating liquid to a mixing fitting 10, communicating with ozone supply reservoir 19, which accepts the tubulation by conventional slip-on engagement. Actinic ozone is drawn from the supply reservoir 19 in which it is produced through the fitting 10 and thence into the liquid stream by venturi action through a dispensing nozzle 30 pointed downstream, the resulting ozone bubbles 32 being carried downstream to a second tubulation 9' connected to the fitting 10 by a similar slip-on connection. The ozonated water is then delivered through a conventional hand-held nozzle assembly 11 to exit through a nozzle 34 in the form of a high-pressure pulsing jet 36 carrying ozone bubbles 32 for local application at the gum line.

The ozone source 19 must be capable of producing "actinic" ozone of the type produced by ultraviolet radiation, as contrasted with the more conventional spark ozone produced by many air freshening and purification systems. As pointed out in U.S. patent application Ser. No. 251,195, filed Apr. 6, 1981 now abandoned (incorporated herein by reference), if air is given a high intensity irradiation by ultraviolet light in the wavelength region of 149 nanometers, a polyatomic complex of oxygen or a "nascent" species thereof is believed to be produced. The exact nature of this species is at present unknown, however, it is believed to be an oxygen molecule consisting of at least five or possibly six oxygen atoms per molecule. The germicidal properties of bubbles of this actinic ozone in water have been employed with marked success in water purification systems, as for example in swimming pools, as a replacement for conventional chlorination. Hereinafter, throughout this disclosure, the terms "ozone" and "actinic ozone" will be used interchangeably to denote a gas of this type, whether produced by ultraviolet radiation in the actinic wavelength of 149 nanometers, or by other means.

The ozone source 19 consists of a sealed chamber 20 with an air inlet passage 21 at the top, and a check valve 28 of conventional design at the bottom leading to the dispensing nozzle 30 inside the mixing fitting 10. Air will enter the top of the chamber 20 to exit the chamber through the check valve 28 because of venturi action at the nozzle 30 as the water stream passes by at high velocity. Actinic ozone is produced from the air in chamber 20 by means of an ultraviolet lamp 22 of the general type described in the previously-referenced U.S. patent application, the lamp being supported at both ends by electrical fittings 24, and being powered from the AC mains from a power plug 15 as schematically shown in FIG. 1. A switch S1 in the power line serves to activate the ultraviolet lamp 22. A conventional ballasttype starter 26 is employed to initiate the discharge in the lamp 22, the particular type of control circuit represented by starter being determined by the electrode configuration built into the ultraviolet lamp. A variety of starter and sustaining systems may be employed for this purpose.

The chamber 20 is thus flooded with actinic radiation to produce the requisite ozone concentration in the air traversing the chamber. The check valve 28 is of a conventional spring-loaded type, being drawn from its seat under the partial vacuum produced in the nozzle 30, and serves to prevent water flow back into the chamber during low-pressure periods between each pulse of hydraulic pressure. This embodiment is preferred, since the actinic ozone bubbles 32 are produced immediately upstream of the dispensing nozzle 30, resulting in a high concentration of such actinic ozone bubbles in the water stream. It is evident that such a system may be readily configured as a simple attachment to existing periodontal irrigation systems.

Figure 2:
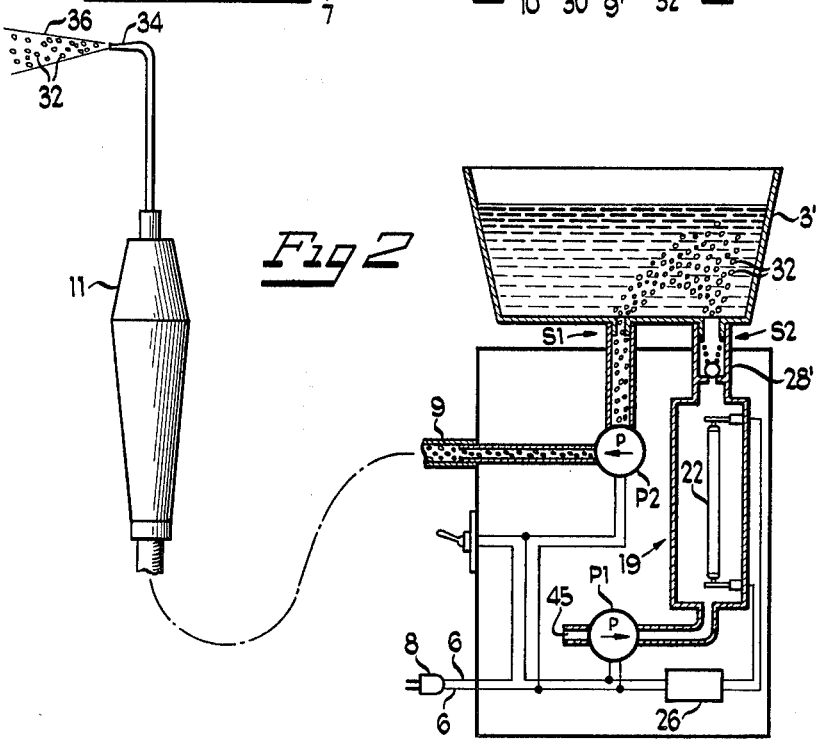
FIG. 2 is a side view partly in section of the second embodiment of the invention.

FIG. 2 shows an alternative embodiment wherein the ozone bubble dispersal is produced in the reservoir 3' of a similar dispensing system. In all subsequent discussion of the apparatus shown in FIG. 2, elements having substantially identical function to elements shown in FIG. 1 will be given the same numerical designations. In this embodiment the system contains two pumps, P1 and P2. Pump P1 is a pressure pump of conventional design, serving to draw air in through an inlet 45 to deliver it under pressure to an irradiating chamber 19 similar in general to chamber 19 of FIG. 1. A similar check valve 28' is interposed between the output of the chamber 19 and a sealing fitting S2 in the bottom of reservoir 3'. The gas flow results in a dispersal of fine ozone bubbles 32 in the liquid in reservoir 3'. The remainder of the system is a conventional dental irrigator, consisting of a sealing tube fitting S1 at the base of the tank passing the liquid therein to a pressure pump P2, the pressure pump P2 delivering the liquid from the reservoir 3' through flexible conduit 9 to a dispensing hand-held nozzle assembly 11. Thus, the actinic ozone bubbles 32 in the reservoir are drawn into pump P2 to be dispensed at the exit nozzle 34 in the form of a jet-like spray 36 consisting of water and ozone bubbles 32, as in the previous case.

A periodontal irrigation system has been shown in two embodiments, one of which may be adapted directly to commercially available units. The use of ozonated water as a treatment for periodontal infections appears to be efficacious, non-toxic and non-irritating.

While for the purposes of illustration, various forms of this invention have been disclosed, other forms thereof may become apparent to those skilled in the art upon reference to this disclosure and, therefore, this invention shall be limited only by the scope of the appended claims. In particular, it should be recognized that the vehicle carrying the actinic ozone need not be water, but may be of higher viscosity to prolong the entrapment period of fine bubbles, particularly in the case of the second embodiment described herein. Such a liquid must, however, fulfill the obvious requirement that it be of such a type that it is not substantially chemically reactive with actinic ozone.

I claim:

1. An apparatus for the treatment of periodontal infections comprising:

means for producing actinic ozone of the variety which is produced by irradiation of air by radiation having a substantial energy content in the vicinity of 145 nanometers;

means for producing a dispersion of bubbles of said actinic ozone in a liquid dispensed from a source thereof; and, hand-held nozzle means for dispensing said dispersion and liquid under pressure to the periodontal region.

2. The apparatus of claim 1 wherein said means for producing actinic ozone includes irradiation means for irradiating a quantity of oxygen-containing gas by radiation having a substantial energy content in the vicinity of 145 nanometers.

3. The apparatus of claim 2 wherein said means for producing actinic ozone includes first conduit means having inlet means for admitting a quantity of oxygen-containing gas thereto and outlet means therefrom communicating with said means for forming a dispersion, said first conduit means having said irradiation means disposed therein, said apparatus including first pumping means for pumping said oxygen-containing gas into said inlet means to be irradiated by said irradiation means and for pumping said gas after irradiation to said means for producing a dispersion.

4. The apparatus of claim 3 wherein said means for dispensing said dispersion includes second conduit means communicating with said source through inlet means at one end thereof and having a dispensing nozzle means at the other end thereof, second pumping means for forcing said fluid from said source to said dispensing nozzle means, said means for producing said dispersion includes second inlet means on said second conduit means communicating with the outlet means of said first conduit means so as to admit said irradiated gas as bubbles forced by said first pumping means into said liquid flowing in said second conduit means.

5. The apparatus of claim 4 wherein said means for producing said dispersion includes gas nozzle means disposed on said outlet means of said first conduit means and disposed inside said second conduit means and oriented to point downstream in said liquid, so that the flow of said liquid past said gas nozzle means creates a partial vacuum therein to draw said oxygen-containing gas into said irradiating means and said irradiated gas therefrom into said liquid.

6. The apparatus of claim 5 further comprising a reservoir tank having an outlet means communicating with said inlet means of said second conduit means, so that when filled with a quantity of said liquid, said reservoir tank serves as said source of said liquid.

7. The apparatus of claim 3 further comprising a reservoir tank for holding a quantity of said liquid so as to serve as said source thereof, said reservoir having an outlet means, said means for dispensing said dispersion including second conduit means communicatingly connected to said outlet means of said reservoir and having a dispensing nozzle means at the other end thereof, said means for dispensing including second pumping means for forcing said fluid from said reservoir to said dispensing nozzle means, said means for producing said dispersion including an inlet means to said tank disposed at a low portion thereof and communicating with said outlet means of said first conduit means, so that said first pumping means forces said irradiated gas into said reservoir below the surface of said quantity of liquid to form a dispersal of bubbles of said irradiated gas therein, and so that said second pumping means pumps said dispersal from said reservoir to said dispensing nozzle means through said second conduit means.

8. The apparatus of claims 4, 5, 6 or 7 wherein at least a portion of said second conduit means is flexible, so as to facilitate the orientation of said dispensing nozzle means during periodontal irrigation.

9. The apparatus of claim 1 wherein at least the major portion of said liquid is water.

10. A method for treatment of periodontal infections, said method comprising the steps of:

preparing a dispersal of bubbles of actinic ozone in a quantity of liquid, said actinic ozone being of the variety produced by irradiation of air by radiation having a substantial energy content at wavelengths in the vicinity of 145 nanometers; and, dispensing said dispersal and liquid under pressure directly to the periodontal region to be treated.

11. The method of claim 10 wherein said dispersal is prepared by irradiating an oxygen-containing gas with ultraviolet radiation having a substantial energy content at wavelengths in the vicinity of 145 nanometers, and passing said gas into said quantity of liquid to form bubbles thereof therein.

12. The method of claims 10 or 11 wherein at least the major portion of said liquid is water.

13. The apparatus of claim 2 wherein said oxygen-containing gas is air.

14. The method of claim 11 wherein said oxygen-containing gas is air.

* * * * *